US005921529A

United States Patent [19]

Wilson, Sr. et al.

[11] Patent Number: 5,921,529

[45] **Date of Patent: *Jul. 13, 1999**

[54] HIGH LINE PULL WINCH ASSEMBLY

[75] Inventors: John M. Wilson, Sr.; Dean R. Wilson, both of Marrero, La.

[73] Assignee: Wilco Marsh Buggies & Draglines, Inc., Marrero, La.

[ * ] Notice: This patent issued on a continued prosecution application filed under 37 CFR 1.53(d), and is subject to the twenty year patent term provisions of 35 U.S.C. 154(a)(2).

[21] Appl. No.: 08/706,614

[22] Filed: Sep. 5, 1996

[51] Int. Cl.[6] ..... B66D 1/14

[52] U.S. Cl. ..... 254/346; 254/357; 254/358; 254/376; 242/396.9

[58] Field of Search ..... 254/346, 357, 254/356, 358, 361, 365, 376, 375; 242/396.9

[56] References Cited

U.S. PATENT DOCUMENTS

| | | | |
|---|---|---|---|
| 757,333 | 4/1904 | Moore | 254/357 |
| 2,067,388 | 1/1937 | Garner, Jr. | 254/346 X |
| 2,351,654 | 6/1944 | Anderson | 254/346 X |
| 2,718,377 | 9/1955 | Ward | 254/346 X |
| 2,725,213 | 11/1955 | Webster | 254/358 X |
| 3,556,185 | 1/1971 | Lykkeberg | 83/418 |
| 3,618,898 | 11/1971 | Notestine | 254/346 X |
| 4,334,670 | 6/1982 | Kawabe | 254/346 |
| 4,489,919 | 12/1984 | Ostobod | 254/346 |
| 4,552,340 | 11/1985 | Sheppard | 254/346 X |
| 4,754,825 | 7/1988 | Scheffer | 254/358 X |
| 5,402,986 | 4/1995 | Wiltse | 254/358 |

OTHER PUBLICATIONS

Undated Document entitled "Wilco Marsh Buggies, Inc. Experts in De–Watering and Disposal Area Construction".

*Primary Examiner*—Donald P. Walsh
*Assistant Examiner*—Emmanuel M. Marcelo
*Attorney, Agent, or Firm*—Shawn Hunter; Conley, Rose & Tayon, P.C.

[57] ABSTRACT

A hydraulic winch which is capable of generating significant amounts of torque and providing very high line pull even after a significant amount of cable is wrapped onto its spool. The winch spool is also capable of carrying a large amount of thick cable. It is useful in applications such as assisting maintenance of dredge disposal areas in which a ditching machine must be assisted by a tether across the pit of the disposal area. In the described embodiment, the novel winch includes a transportable base or skid which is affixable to a prime mover vehicle, a heavy duty spool, a chain drive and a power train. The power train for the winch is powered by a hydraulic motor. Through significant gear reduction via the chain drive and a hydraulic gear box, the winch is capable of generating sustained significant torque regardless of the amount of cable on the spool. A selectively engageable clog or dog assembly permits the spool to be unengaged so that "free spooling" can occur to permit the cable to be unrolled freely despite operation of the hydraulic motor. Additionally, the winch includes a manual brake assembly which selectively stops the spool from unrolling the cable. The winch also includes a backlash preventor in which a Teflon® drag member is maintained in frictional engagement against portions of the spool to govern the speed at which the spool will rotate.

18 Claims, 4 Drawing Sheets

HIGH LINE PULL WINCH ASSEMBLY

BACKGROUND OF THE INVENTION

1. Field of the Invention

The present invention relates generally to winches and associated equipment.

2. Description of Related Art

Contemporary hydraulic winch designs suffer from drawbacks of non-constant torque, power transfer and cable limitations. A winch will provide the greatest torque on the cable being winched when the cable is unspooled and before any cable has been wrapped around the spool of the winch. As the cable wraps around the spool, the torque decreases as well as the amount of "line pull," the effective tension exerted on the cable by the winch. No hydraulic winch known to the applicant is capable of generating very high line pull (on the order of 45,000 lbs), particularly after a number of wraps of cable are added to the spool. Conventional winches are also limited in the amount of large diameter cable (such as 9/16") which they can carry. Typically, this amount is on the order of 500 feet or so. This limitation is imposed principally by the size of the spools and windings of the winches. Related, however, is the fact that the hydraulic motor for a contemporary hydraulic winch is typically rated at a particular capacity for line pull. If the winch reaches or exceeds its rated capacity, a bypass or relief feature will prevent the winch from providing additional line pull.

SUMMARY OF THE INVENTION

A positive drive hydraulic winch is described which is capable of generating significant amounts of torque and providing very high line pull even after a significant amount of cable is wrapped onto its spool. The winch spool is also capable of carrying a large amount of thick cable. A winch constructed in accordance with the present invention is useful in applications such as assisting maintenance of dredge disposal areas in which a ditching machine must be assisted by a tether across the pit of the disposal area. In the described embodiment, the novel winch includes a transportable base or skid which is affixable to a prime mover vehicle, a heavy duty spool, a chain drive and a power train. The power train for the winch is powered by a hydraulic motor. Through significant gear reduction via the chain drive and a hydraulic gear box, the winch is capable of generating sustained significant torque regardless of the amount of cable on the spool. A selectively engageable clog or dog assembly permits the spool to be unengaged so that "free spooling" can occur to permit the cable to be unrolled freely despite operation of the hydraulic motor. Additionally, the winch includes a manual brake assembly which selectively stops the spool from unrolling the cable. The described winch also includes a backlash preventor in which a TEFLON® disk is maintained in frictional engagement against portions of the spool to govern the speed at which the spool will rotate.

DETAILED DESCRIPTION OF THE PREFERRED EMBODIMENT

Figure 1:
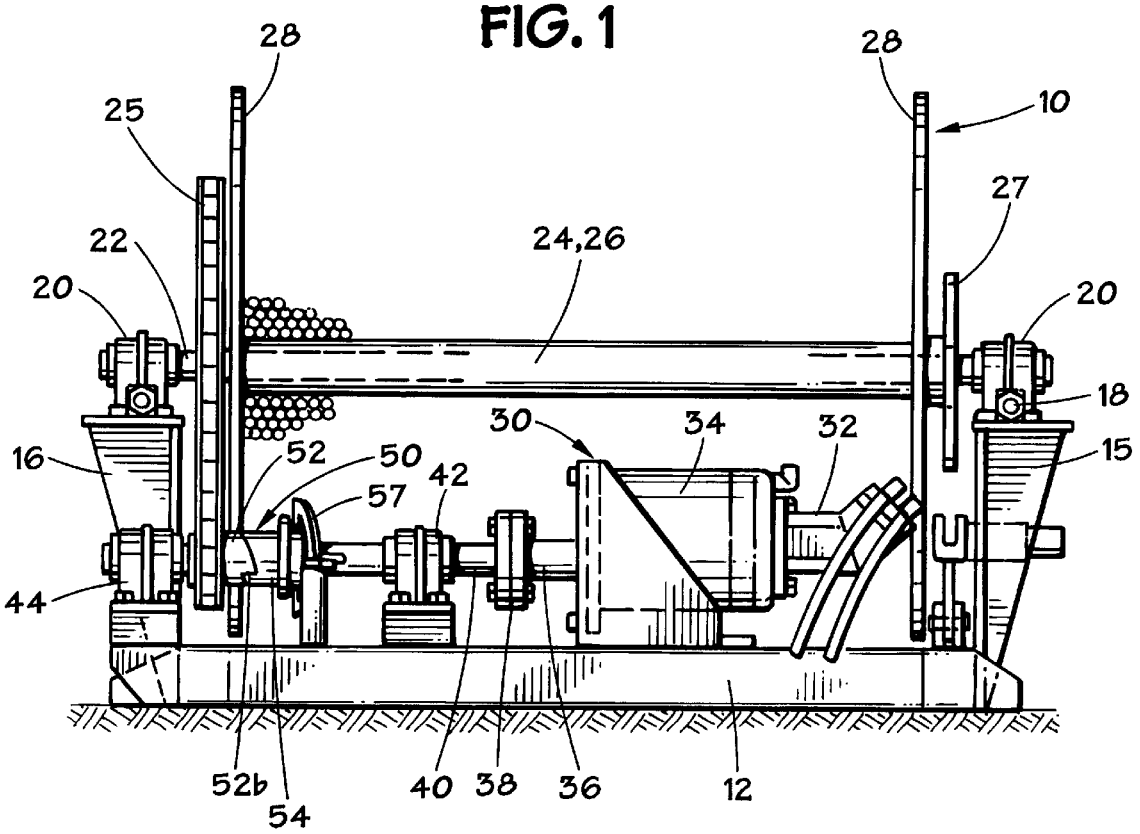
FIG. 1 is a front view of an exemplary winch assembly in accordance with the present invention.

FIGS. 1–4 depict an exemplary winch which has been constructed in accordance with the present invention. The winch 10 includes a transportable skid or base 12 having bolt holes 14 by which the base 12 may be affixed to a vehicle or other object. Extending upwardly from either lateral side of the base are a pair of vertical side supports 16. Upon each is a pillow block bearing 20 which is adjustably mounted on the supports 16 by adjustable mounting bolts 18. It is preferred that the pillow blocks 20 include a bearing which is of high strength. In the described embodiment, the pillow block 20 includes a 3¼" bearing. Through both pillow blocks runs a shaft 22 which carries cable spool 24. The size of shaft 22 is regulated by the cable size and strength. In the preferred embodiment, the shaft is 3¼" in diameter. In operation, the spool will carry cable (not shown) of a type which is generally known in the industry. It is highly preferred that the cable used be 9/16" in diameter. Also fixedly mounted on the shaft 22 is a toothed spool sprocket 25 and a notched circular plate 27,best shown in FIG. 4. There are preferably at least 3 or 4 notches 27*a* disposed in the periphery of the plate 27.

The spool 24 includes a spool winding 26 which surrounds the shaft 22 and a pair of side plates 28. Preferably, the side plates 28 are 1" in thickness. For a spool capable of carrying 6,000' of cable, a plate 3" in diameter is suggested. For a spool capable of carrying 12,000' of cable, a 4' diameter plate is suggested. The length of the winding 26, measured from side plate to side plate, is preferably approximately 3'.

The winch 10 also includes a drive train assembly 30. The drive train assembly 30 is secured to the base 12 by bolting or other secure connection means. The drive train assembly 30 includes a hydraulic motor 32, which provides high torque and low speed (ie., low RPM). An example is an 8.2 displacement hydraulic motor of the type manufactured by the Caterpillar, SunStrand, or Dennison companies. In a manner known in the art, the hydraulic motor 32 is operationally interconnected with a hydraulic pump (not shown) and hydraulic tank (not shown) for the supply of hydraulic fluid to the motor 32. These components are normally located on the vehicle upon which the winch is carried and are powered by that vehicle's engine.

Figure 2:
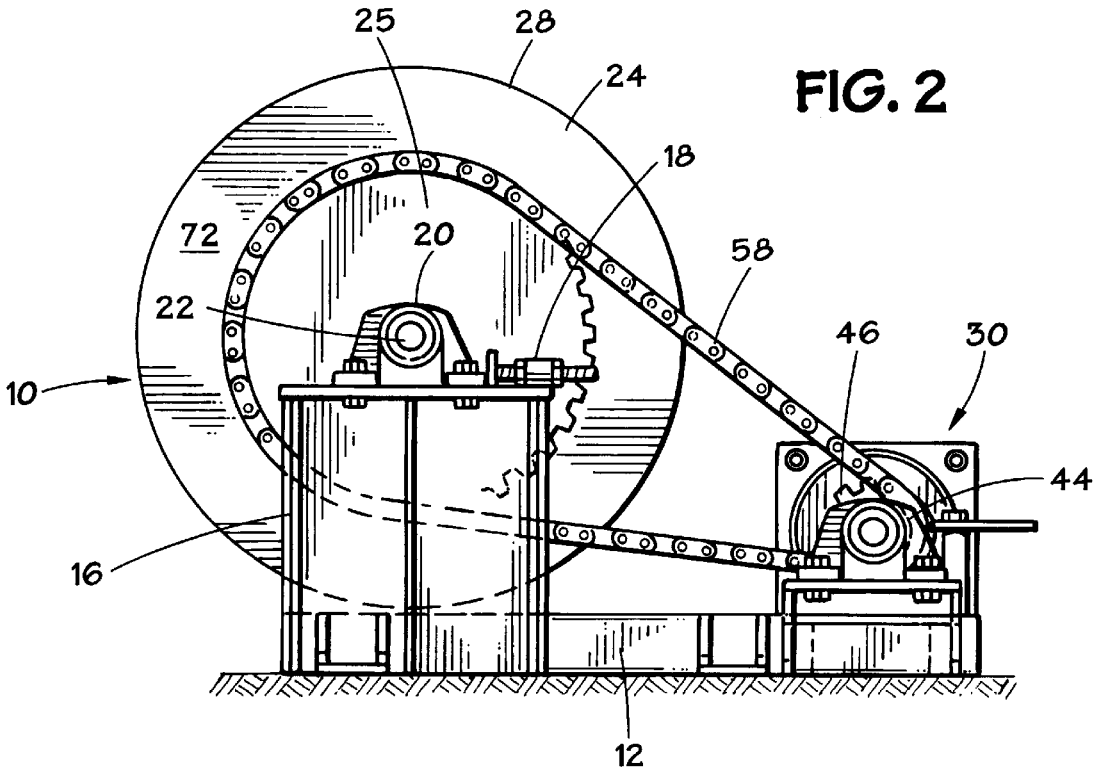
FIG. 2 is a left side view of the winch of FIG. 1.
Figure 6:
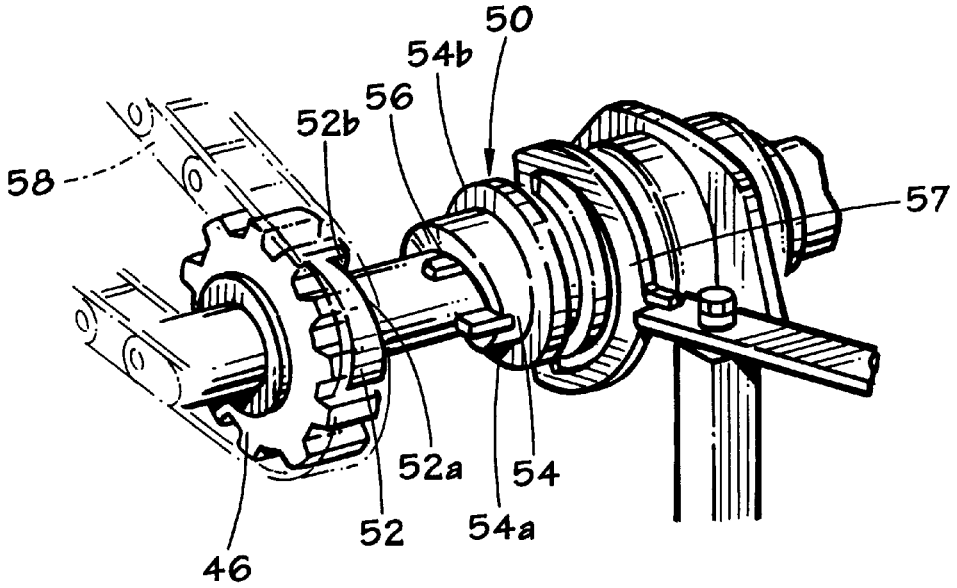
FIG. 6 is a detail showing exemplary interengagable dogs and a coordinating yoke arrangement.

The hydraulic motor 32 is operably interconnected via splines (not shown) with hydraulic gear box 34. A suitable device for use as the gear box 34 is a hydraulic planetary manufactured by Funk Manufacturing of Coffeville, Kans. The gear box 34 serves as a gear reducer. Preferably, the gear box 34 provides for 24:1 gear reduction. Extending from the gear box 34 is an output shaft 36 which is affixed by coupling 38 to drive shaft 40. The drive shaft 40 is mounted proximate base 12 by two high-strength pillow blocks 42 and 44. The drive shaft 40 is preferably of 3" in diameter and formed of 4140 Rockwell hardness steel. Each of the pillow blocks 42, 44 includes a 3" bearing within it. A toothed drive sprocket 46, best shown in FIGS. 2 and 6, is mounted upon the drive shaft 40 for rotation therewith. The drive sprocket 46 is smaller than the spool sprocket 25. In presently preferred embodiments, the spool sprocket 25 has four times as many teeth as drive sprocket 46. A selectively engageable clog or dog assembly 50 is mounted proximate the drive sprocket 46. The dog assembly 50 features a pair of selectively engageable halves 52, 54. The first half 52 is fixedly secured to drive sprocket 46 for rotation therewith. The second half 54 is keyed via a key 56 to the drive shaft 40. The second half 54 may be axially moved between a first position (see FIGS. 1 and 3) wherein it will selectively engage with first half 52, and a second position (see FIG. 6) wherein it will not engage first half 52. A yoke 57 is used to move the second half 54 between the first and second positions. The engageable portions of each half 52, 54 present angularly tapered surfaces 52*a*, 54*a* (see FIG. 6) and interengageable shoulders 52*b*, 54*b*. When the second half 54 is moved into its first position, the shoulders 52*b*, 54*b* should engage each other (as in FIG. 1) such that rotation of the drive shaft 40 in the direction to maintain this interlock will cause the drive sprocket 46 to be rotated. Rotation of the drive shaft 40 in the opposite direction will cause the tapered surfaces to be engaged and the two halves 52, 54 will become disengaged from each other so that the drive sprocket 46 is not rotated.

A drive chain 58 interconnects the drive sprocket 46 and spool sprocket 25 so that the teeth of each sprocket engage links of the drive chain 58. When the drive sprocket 46 is rotated about the drive shaft 40, the spool sprocket 25 is also rotated. The chain drive's connection between the smaller drive sprocket 46 and the larger spool sprocket 25 preferably provides for a 4:1 gear reduction between the drive shaft 42 and shaft 22. Through combination of the 24:1 gear reduction provided by gear box 36, with that provided by the chain drive, a total significant gear reduction of 96:1 is achieved. As a result of this significant gear reduction ratio, the torque generated in rotation of the spool is greatly increased. This increased torque permits a relatively high and constant amount of line pull to be exerted by the winch even after significant amounts of cable have been wound onto the spool 24.

Adjustable mounting bolts 18 allow the pillow block bearings 20 to be adjusted axially, thereby allowing the spool 24 to be adjusted axially with respect to the skid 12 to provide proper tension on the drive chain 58.

Figure 3:
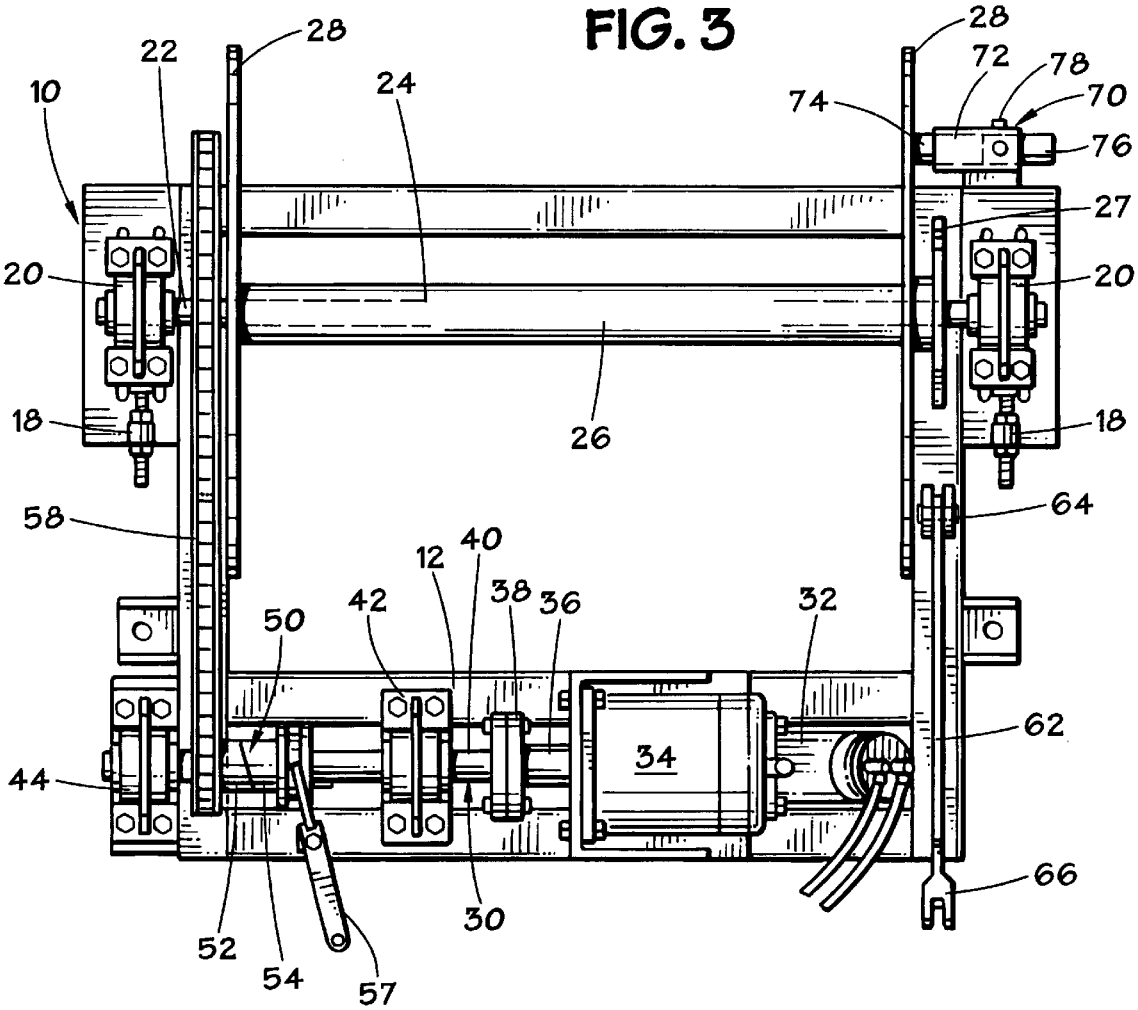
FIG. 3 is a plan view of the winch of FIG. 1.
Figure 4:
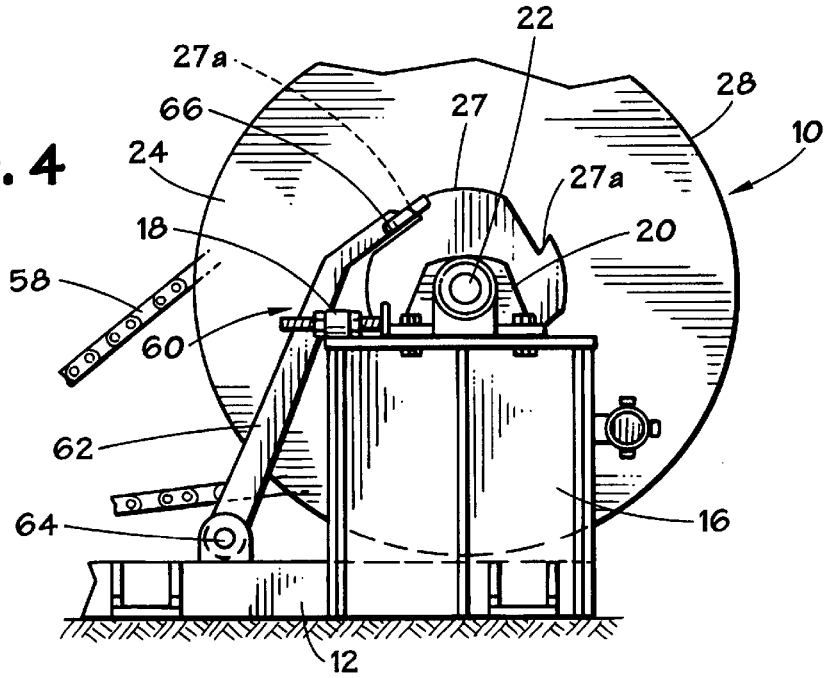
FIG. 4 is a right side view of the winch of FIG. 1.

A brake assembly 60 is also included on winch 10 and is best understood by reference to FIGS. 3 and 4. A brake arm 62 is pivotally connected to the base 12 at pivot joint 64. The end of the brake arm 62 opposite the pivot joint 64 presents a forked engagement portion 66 which is shaped to be generally complimentary to the notches 27*a* in circular plate 27. The brake arm 62 is pivotally movable between two positions. In the first position, the brake arm 62 is pivoted downwardly away from the circular plate 27 so that its engagement portion 66 is not engaged with the plate 27. When it is desired to engage the brake assembly 60, the brake arm 62 is pivoted upwardly toward the circular plate 27 and the engagement portion 66 is brought into engagement with a notch 27*a* in the plate 27. The brake assembly 60 is useful as a device for stopping rotation of the spool 24 quickly, as in an emergency. The brake assembly 60 can be engaged, as described, to quickly stop rotation. The brake assembly 60 may also be engaged when the spool 24 is not moving and it is desired to prevent it from doing so. The brake assembly 60 only locks in one direction. During the winching operation, the brake assembly 60 is not engaged.

Figure 5:
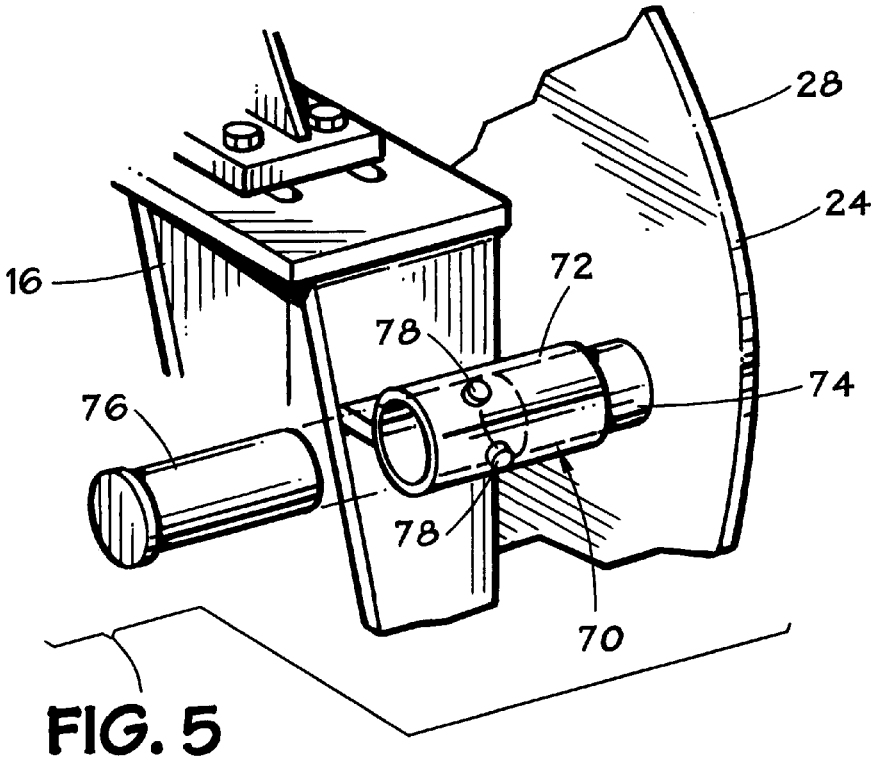
FIG. 5 is a detail showing an exemplary backlash preventer assembly.

A backlash preventor assembly 70 is also included on the winch 10. It is best shown in FIG. 3 and, in an exploded view, in FIG. 5. The backlash preventor assembly 70 includes a hollow tube 72 which is fixedly mounted on vertical support 16. A cylindrical TEFLON® drag member 74 and a second cylindrical member 76, formed of metallic or another rigid material, are disposed within the hollow tube 72. Finally, one or more bolts 78 are disposed through the walls of the tube 72. The backlash preventor is employed by inserting the drag member 74 into the tube 72 such that it contacts a side plate 28 of spool 24. The second cylindrical member 76 is then also inserted into the tube 72 behind the drag member 74 and the bolts 78 tightened against the second member 76. This arrangement then maintains the drag member 74 in frictional engagement with the side plate of spool 24. This frictional engagement resists rotation of the spool 24 and prevents it from rotating too quickly as would occur if the winch cable were to break causing a backlash.

In operation, the winch 10 can generate significant amounts of line pull and sustain the line pull even as cable wraps onto the cable spool 24. The winch operates in a "positive drive" manner because it will not prevent additional line pull from being generated due to a capacity limitation for the hydraulic motor 32 is reached. The significant gear reduction ratio previously described between the hydraulic motor 32 and the spool 24 makes it highly improbable that the capacity limitation of the hydraulic motor would be exceeded during operation.

Figure 7:
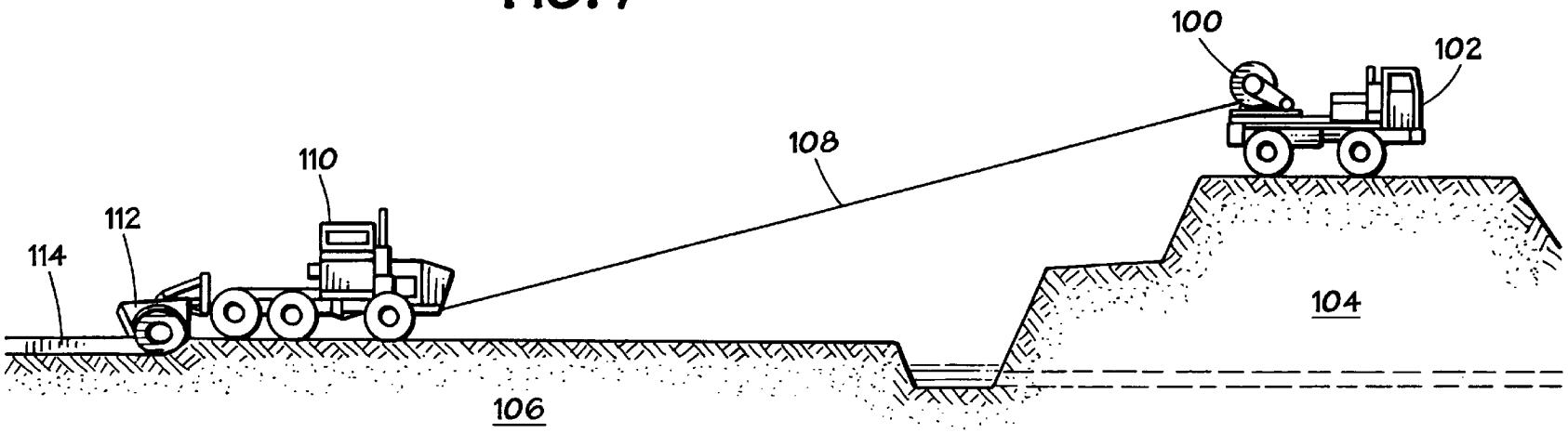
FIG. 7 depicts an exemplary winch in use in a dredge disposal containment area.

The winch of the present invention has been found to be greatly useful in crust management operations such as the maintenance of dredge disposal sites. Methods associated with this type of maintenance are described in greater detail in U.S. patent application Ser. No. 08/78,648, entitled "Containment Area Process," also assigned to the present assignee. A winch constructed in accordance with the present invention has been found to be particularly useful in instances in which digging machinery must be assisted in crossing a dredge disposal area where obtaining sufficient traction for ditching is difficult or impossible. FIG. 7 illustrates such an arrangement. As shown there, a winch assembly 100 is mounted upon a winch vehicle 102. An example of an acceptable wheeled winch vehicle for crust management work is a Rolligon, available from Rolligon Corporation, 10635 Brighton Lane, Stafford, Tex. 77477, (713) 495–1140. A tracked winch vehicle such as a personnel marsh buggy made by Wilco Marsh Buggies, Inc. of Marrero, La., may be used as well. The winch 100 and winch vehicle 102 are positioned upon a levy 104 which surrounds a dredge spoil containment area pit 106. A winch cable 108 runs from the winch 100 to a digging vehicle 110 where it is affixed to the digging vehicle 110 to tether it to the winch vehicle 110. The digging vehicle 110 includes a rotary ditcher 112, of a type known in the art, which is operated to construct a ditch 114 in the pit 106 as the digging vehicle 110 is pulled across the pit 106 by the winch 100.

While the invention has been herein shown and described in what is presently believed to be the most practical and preferred embodiment thereof, it will be apparent to those skilled in the art that many modifications may be made to the invention described while remaining within the scope of the claims.

What is claimed is:

1. A winch comprising:

(a) a cable spool for winding of a cable about the spool under line pull tension, the cable spool disposed on a first mount;

(b) means for generating a relatively constant line pull tension of at least 45,000 lbs. as the cable spool winds cable about the spool, the means for generating line pull tension including:

1) a power train assembly disposed on a second mount; and 2) a chain drive operably interconnecting the power train assembly to the cable spool;

(c) the first mount being adjustable with respect to the second mount to vary the tension on the chain drive.

2. The winch of claim 1 wherein the power train assembly includes a power source and a gear reduction between the power source and the cable spool.

3. The winch of claim 2 wherein the power source comprises a hydraulic motor which is powered by a vehicle engine.

4. The winch of claim 1 wherein the cable spool is of a size sufficient to wind at least six-thousand feet of 9/16" diameter cable.

5. The winch of claim 1 wherein the power train assembly further comprises a power source, a drive shaft and a clog assembly for selectively engaging and disengaging the drive shaft and power source for selective power transmission.

6. The winch of claim 5 wherein said clog assembly comprises a pair of interlockable dogs formed of selectively engageable halves which each present interengageable shoulders.

7. The winch of claim 6 herein said halves are selectively engageable by operation of a yoke assembly which is operably interconnected with one of said halves.

8. The winch of claim 1 further comprises a winch base which is transportable and affixed to a mount.

9. A winch comprising:

(a) a cable spool for winding of a cable about the spool under line pull tension;

(b) a power train assembly;

(c) a chain drive operably interconnecting the power train assembly to the cable spool; and the chain drive being selectively operable to generate a relatively constant line pull tension of approximately 45,000 lbs. as the cable spool winds a cable about the spool; and means for axially adjusting the spool so as to change tension on said chain drive.

10. A winch assembly comprising:

(a) a drive train assembly for driving a rotatable spool shaft, the drive train assembly comprising;

(1) a power source;

(2) a cylindrical drive shaft being rotatable by the power source;

(3) a gear reducer operably interconnected between the power source and drive shaft for increase of torque;

(b) a rotatable spool shaft having an affixed cable spool for winding of cable, and at least one circular plate mounted thereupon and having a notch upon the periphery of the plate; and (c) a selectively engageable brake assembly for the cable spool, comprising a brake arm which is moveable to selectively engage said notch of said plate to prevent rotation of the spool.

11. The winch assembly of claim 10 wherein selective engagement of said brake assembly prevents rotation of the spool in only one direction.

12. A winch comprising:

(a) a cable spool for winding of a cable about the spool under line pull tension;

(b) a power train assembly;

(c) a chain drive operably interconnecting the power train assembly to the cable spool for generating a relatively constant line pull tension as the cable spool winds a cable about the spool;

(d) a backlash preventor assembly, comprising:

(1) a tube;

(2) a generally cylindrical drag member adapted to be disposed within the tube and contact the spool; and (3) a second cylindrical member adapted to be disposed within the tube to contact the drag member and maintain the drag member in contact with the spool.

13. The winch of claim 12 wherein a bolt is disposed through a wall of the tube and is tightenable against the second cylindrical member to maintain the drag member in contact with the spool to resist rotation of the spool.

14. A winch comprising:

(a) a cable spool disposed on a first mount for the winding of a cable about the spool under line pull tension;

(b) a power train assembly disposed on a second mount;

(c) a chain drive operably interconnecting the power train assembly and the cable spool; the chain drive being selectively operable to generate a relatively constant line pull tension as the cable spool winds a cable about the spool; and (d) the first mount being adjustable with respect to the second mount to vary tension on the chain drive.

15. The winch of claim 14 wherein the power train assembly comprises a power source and a gear reduction between the power source and the cable spool.

16. The winch of claim 15 further comprising a drive shaft and a clog assembly for selectively engaging and disengaging the drive shaft and power source for selective power transmission.

17. The winch of claim 16 wherein the clog assembly comprises a pair of interlockable dogs formed of selectively engageable halves which each present interengageable shoulders.

18. The winch of claim 14 further comprising a winch base which is transportable and affixed to a mount.

* * * * *